US006488482B1

(12) United States Patent
Yannascoli et al.

(10) Patent No.: US 6,488,482 B1
(45) Date of Patent: Dec. 3, 2002

(54) INTEGRAL COMPRESSOR MUFFLER

(76) Inventors: Donald Yannascoli, 8543 Lamp Post Cir., Manlius, NY (US) 13104; Peter John Pileski, 253 Woodbine Ave., Syracuse, NY (US) 13206; Thomas S. Katra, 114 Brookside La., Fayetteville, NY (US) 13066

( * ) Notice: Subject to any disclaimer, the term of this patent is extended or adjusted under 35 U.S.C. 154(b) by 0 days.

(21) Appl. No.: 09/656,785

(22) Filed: Sep. 7, 2000

(51) Int. Cl.[7] ..... F04B 39/00

(52) U.S. Cl. ..... 417/312; 62/296; 181/403; 181/270; 181/264

(58) Field of Search ..... 417/312, 902; 62/296; 181/403, 270, 272, 264, 268, 281

(56) References Cited

U.S. PATENT DOCUMENTS 4,061,444 A * 12/1977 Dirk et al. ..... 417/312
5,341,654 A * 8/1994 Hewette et al. ..... 417/312
5,562,427 A * 10/1996 Mangyo et al. ..... 417/902
6,017,197 A * 1/2000 Jensen et al. ..... 417/312

* cited by examiner

*Primary Examiner*—Cheryl J. Tyler
(74) *Attorney, Agent, or Firm*—Bachman & LaPointe, P.C.

(57) ABSTRACT

A fluid compressor includes a compressor inlet for receiving a medium, a compressor for compressing the medium, a compressor outlet for discharging the compressed medium and a compressor muffler. The compressor muffler includes a housing defining an inner space, an inlet for receiving a compressed medium, a muffling structure located in the inner space, wherein the muffling structure has a plurality of chambers for receiving the compressed medium from the inlet, an outlet for discharging the compressed medium and a flow path located in the inner space; The flow path communicates the inlet with the muffling structure and the muffling structure with the outlet; A method for reducing any noise-generating frequencies present in a compressed medium is additionally presented.

8 Claims, 4 Drawing Sheets

INTEGRAL COMPRESSOR MUFFLER

BACKGROUND OF THE INVENTION

The present invention relates to a compressor muffler for reducing noise-generating frequencies imparted to the compressed medium by the compressor.

Conventional compressor mufflers, both external and integral, are well known in the prior art and require large and small volume chambers along with a series of baffles in order to reduce noise-generating frequencies. This requires that the muffler portion of the compressor be relatively large as compared to the rest of the compressor, thereby requiring a large operation space. In addition, because of their design the most commonly used types of compressor mufflers are not able to reduce specific noise-generating frequencies, but rather they attempt to reduce noise-generating frequencies across a broad spectrum. As a result, some of the noise-generating frequencies retain a portion of their magnitude. The need remains for a compressor muffler that performs better or at least as well as conventional compressor mufflers, yet has a more compact housing that would allow a compressor to operate within a smaller space.

It is therefore one objective of the present invention to provide a compressor muffler that is integrally associated with a compressor and more compact, such that the compressor is smaller and requires less room.

It is another objective of the present invention to provide a compressor muffler wherein the compressor muffler can be designed to the individual characteristics of different compressors.

Other objects and advantages will appear hereinbelow.

SUMMARY OF THE INVENTION

In accordance with the present invention, the foregoing objects and advantages are readily attained.

According to the invention, a fluid compressor is provided which comprises: a compressor inlet for receiving a medium; a compressor for compressing said medium thereby creating a compressed medium; a compressor outlet for discharging said compressed medium and a compressor muffler for reducing noise-generating frequencies, wherein said compressor muffler comprises: a housing defining an inner space; an inlet for receiving a compressed medium; a muffling structure located in said inner space, wherein said muffling structure comprises a plurality of chambers for receiving said compressed medium from said inlet; an outlet for discharging said compressed medium; and a flow path located in said inner space, wherein said flow path communicates said inlet with said muffling structure and said muffling structure with said outlet.

BRIEF DESCRIPTION OF THE DRAWINGS

A detailed description of preferred embodiments of the present invention follows, with reference to the attached drawings, wherein.

DETAILED DESCRIPTION

This invention relates to a compressor muffler capable of being integrally mounted to a fluid compressor and having a plurality of chambers designed to perform with specific noise-generating frequencies or with a general range of noise-generating frequencies, depending on the characteristics of the fluid compressor. In addition, this invention relates to a method of reducing noise-generating frequencies.

In accordance with the present invention, a method for reducing noise-generating frequencies includes providing a compressed medium having noise-generating frequencies and a compressor muffler having at least three chambers whose lengths are selected so as to interact with a compressed medium so as to dampen noise-generating frequencies.

Figure 1:
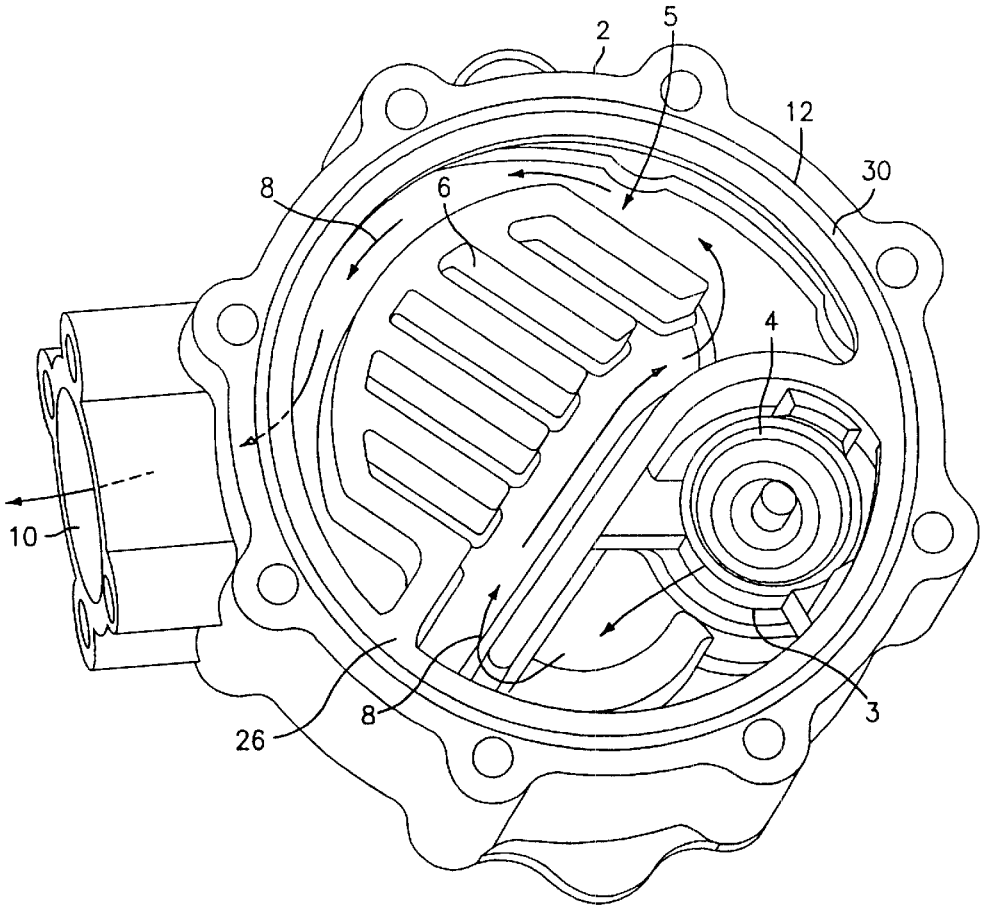
FIG. 1 is a side sectional view of a compressor muffler in accordance with the present invention showing all major components, excluding inlet and muffler cap.
Figure 2:
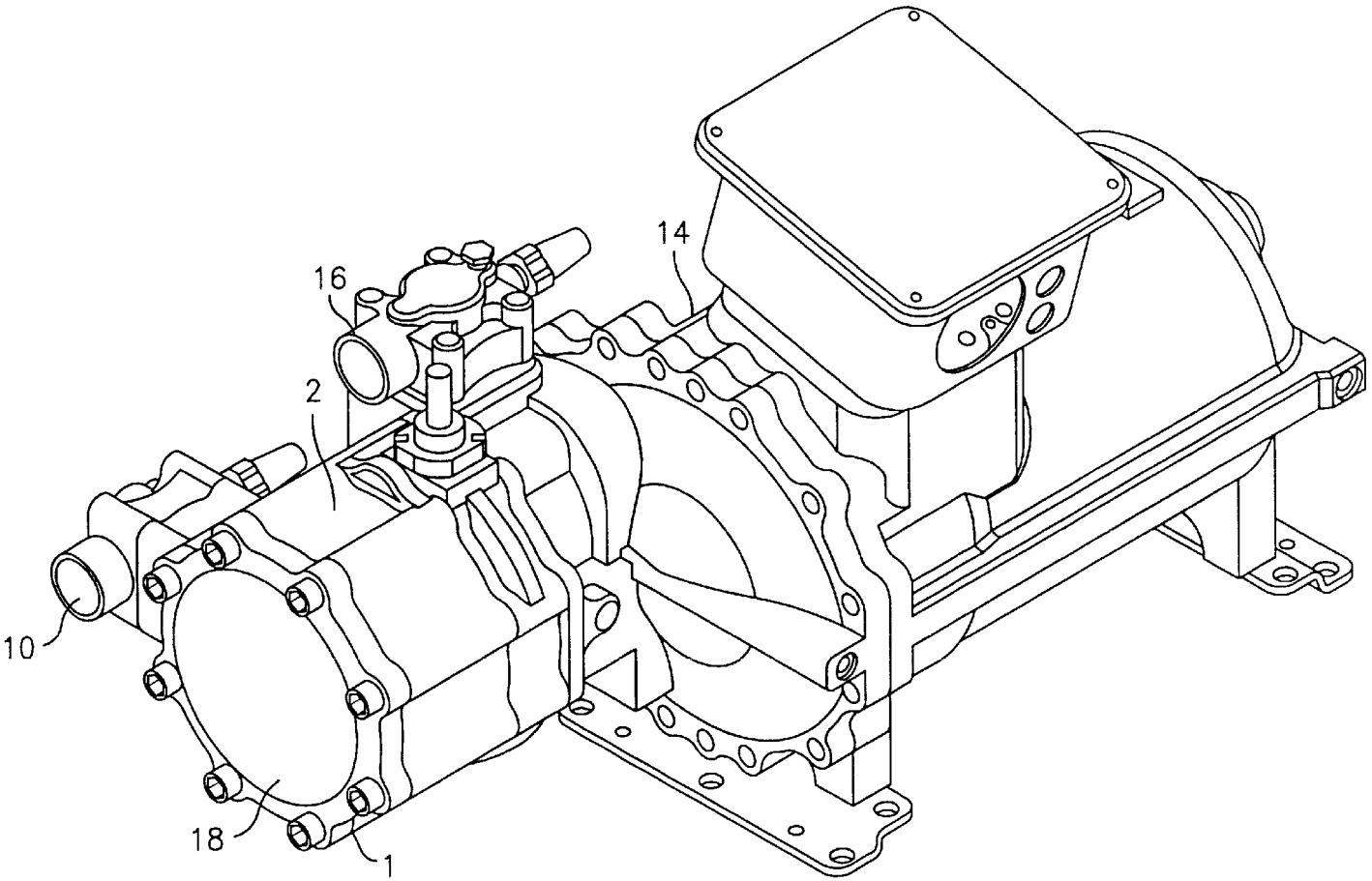
FIG. 2 is an overall view of a fluid compressor comprising a compressor muffler in accordance with the present invention showing all major external components, excluding inlet.
Figure 4:
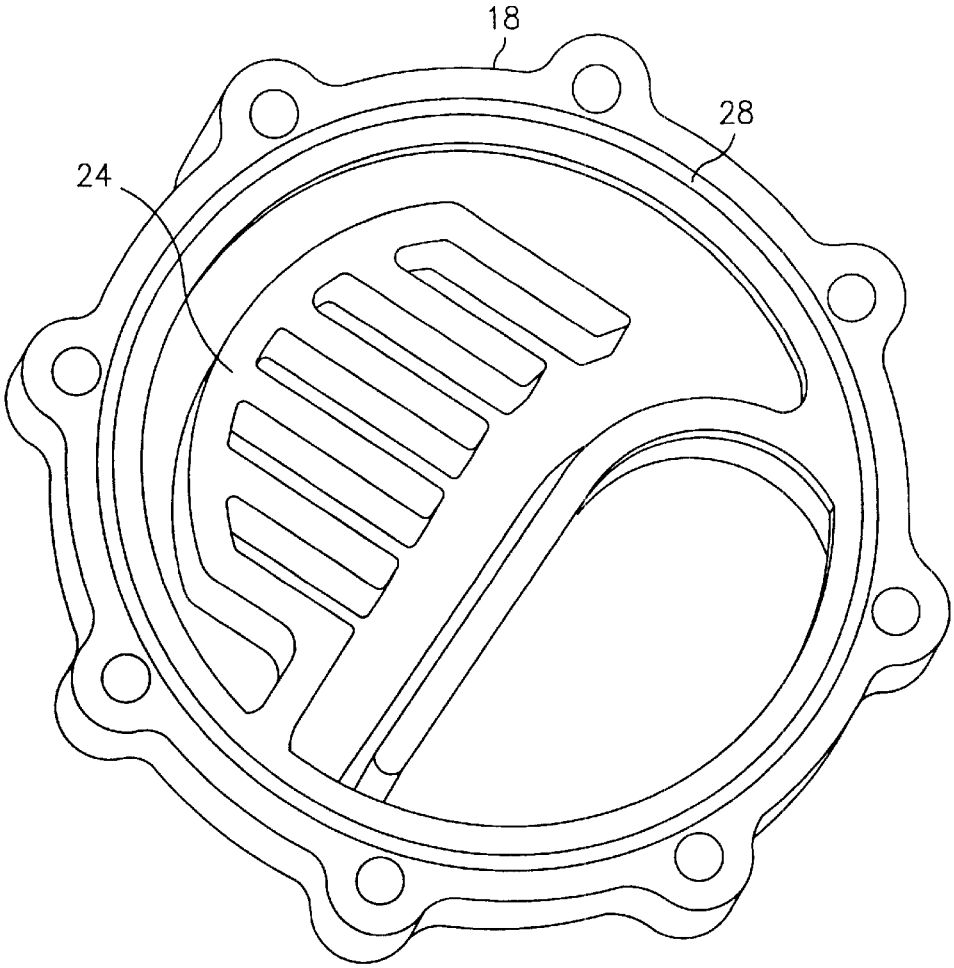
FIG. 4 is a view of the internal surface of the muffler cap showing the upper portion of the muffling structure in accordance with the present invention.

Referring to the drawings, a preferred embodiment of the invention will be discussed. FIG. 1 shows a compressor muffler 1 in accordance with the present invention including a compressor muffler housing 2, an inlet 3, check valve 4, a muffling structure 5, a plurality of chambers 6, a flow path 8, an outlet 10 and a recessed groove 12. FIG. 2 shows a fluid compressor 14 with a compressor muffler integrally mounted thereto in accordance with the present invention. Fluid compressor 14 has a compressor inlet 16, and the compressor muffler 1 includes a housing 2, a compressor muffler outlet 10 and a muffler cap 18. FIG. 4 is an internal view of muffler cap 18 showing an upper portion 24 of muffling structure 5 and a recessed groove 28 for holding an O-ring, in accordance with the present invention.

Housing 2 in this embodiment preferably includes a one piece housing 2 (FIG. 1) defining an inner space for housing muffling structure 5 and having an inlet 3, a check valve 4 and flow path 8. Flow path 8 is defined from inlet 3 and check valve 4, past muffling structure 5 and to outlet 10. Muffling structure 5 preferably has a plurality of chambers 6 positioned to communicate with fluid flowing along said flow path 8. In addition, housing 2 in this embodiment preferably includes outlet 10 for discharging fluid such as compressed medium and is removably mounted to fluid compressor 14 such that the outlet from fluid compressor 14 is aligned with inlet 3 of compressor muffler 1. When a compressed medium is communicated with inlet 3, check valve 4 opens so as to allow the compressed medium to flow into flow path 8. The purpose of check valve 4 is to close when the compressor is shut off in order to prevent reverse flow which can damage the compressor. Flow path 8 directs the compressed medium throughout housing 2 such that the compressed medium interacts with muffling structure 5. When the compressed medium interacts with muffling structure 5, chambers 6 receive and dampen noise-generating pulse frequencies present in the compressed medium. Each chamber of the plurality of chambers 6 is of a specific length preferably selected so as to match a quarter wavelength of a specified range of these noise-generating frequencies thus absorbing the pulse frequency energy and reducing the magnitude of the noise-generating frequencies within this specified range.

Muffling structure 5 as set forth above includes a plurality of chambers 6. Preferably, muffling structure 5 includes at least three chambers, and a muffling structure with five chambers has been found to provide excellent results when demonstrated in the example below. The plurality of chambers are preferably provided having different lengths wherein the lengths and arrangement are selected as described above. so as to interact with the compressed medium and reduce or dampen various frequencies present in the medium. The chamber lengths are preferably selected to match specific noise generating frequencies which may be induced by different compressors or by a single compressor operated using different parameters, such as speed, pressure and the like. This advantageously allows the muffler of the present invention to be used with a variety of different compressors and/or compressor operating parameters.

When the compressed medium has completed its interaction with muffling structure 5, the compressed medium is directed to outlet 10 via flow path 8 and is discharged via outlet 10.

Muffler cap 18 is removably mounted to the housing 2 such that the internal components of compressor muffler 1 can be accessed. Muffling structure 5 is preferably a two-piece structure, with a lower portion 26 disposed in housing 2 and an upper portion 24 disposed on the internal surface of muffler cap 18. When muffler cap 18 is mounted to housing 2, muffling structure 5 is completely assembled. Upper portion 24 of muffling structure 5 on muffler cap 18 serves to enhance the structural strength of muffling cap 18 as well. In addition, when muffler cap is mounted to housing 2, an O-ring is preferably used to seal compressor muffler 1. The O-ring is advantageously held in place between recessed groove 12,28 located in housing 2, and muffler cap 18, respectively. This provides better sealing than is accomplished utilizing conventional gaskets and the like.

Referring back to FIG. 1 and FIG. 2, compressor muffler housing 2, as shown, preferably includes an inlet communicating with a fluid compressor 14 and an outlet 10 for discharging the compressed medium. Fluid compressor 14 preferably includes an inlet 16 for receiving a medium and an outlet for discharging a compressed medium into compressor muffler 1.

In accordance with the present invention housing 2, check valve 4, muffling structure 5, and muffler cap 18 may be constructed of any material suitable to the desired end product. In addition, in accordance with the present invention compressor muffler 1 may be used with any compatible fluid compressor.

In addition, this compressor muffler in accordance with the present invention advantageously provides for a more compact and quieter fluid compressor which occupies less space than that currently occupied by conventional compressors.

It should readily be appreciated that compressor muffler 1, including chambers 6 according to the present invention, also serves to advantageously provide for muffling of different frequencies generated by a compressor operated at different speeds, and/or to provide muffling for a series of different compressors, each of which may a generate compressed medium carrying different frequencies.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

EXAMPLE

Figure 3:
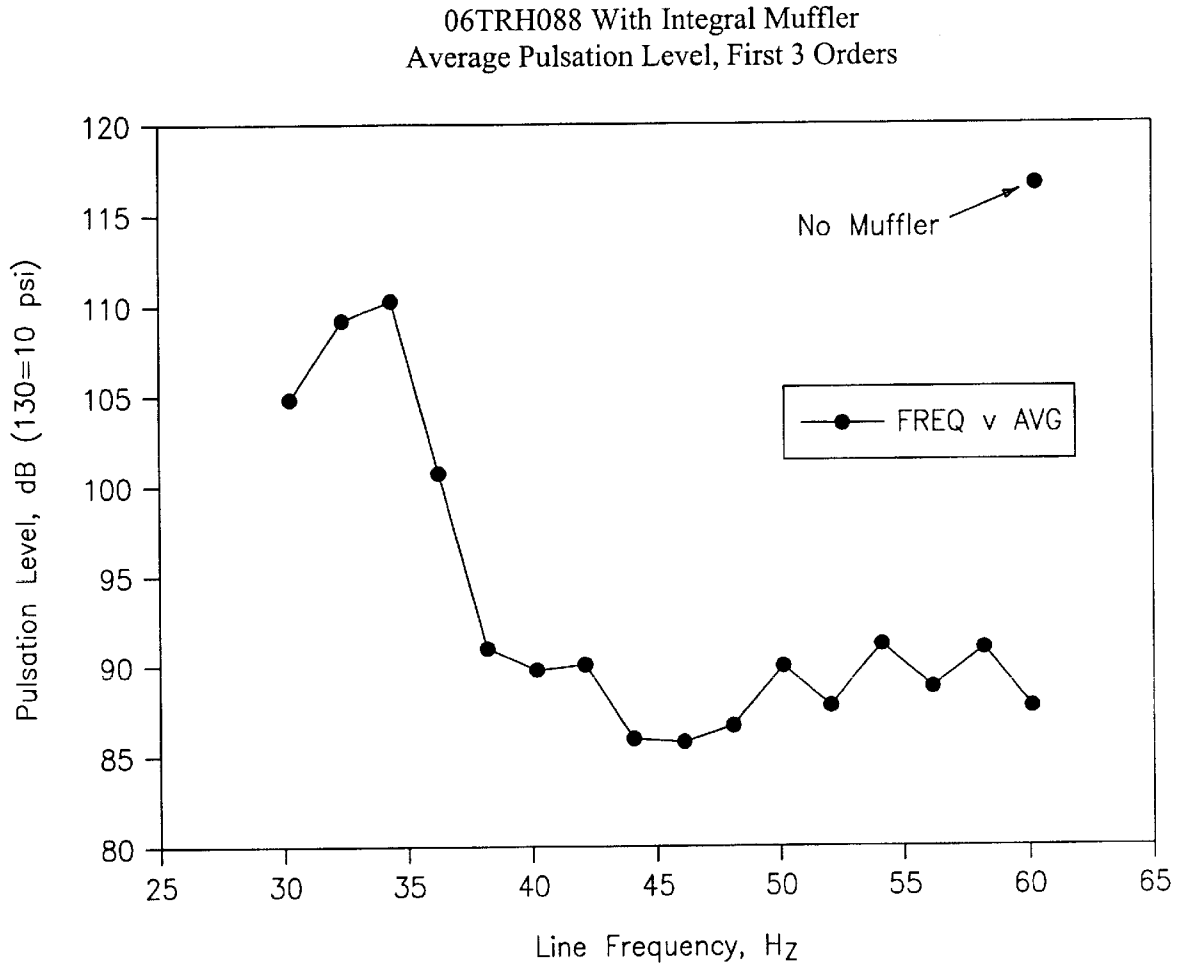
FIG. 3 is a graphical depiction of the performance analysis of a compressor muffler in accordance with the present invention showing the noise level to frequency relationship.

A fluid compressor identified as model 06TRH088, was operated under two conditions. The first condition had no muffler connected to the fluid compressor. The second condition had a compressor muffler integrally mounted to the fluid compressor in accordance with the present invention. This compressor was operated over a range of line frequencies and the average pulsation level present in the compressed medium was measured. The muffler included a muffling structure defining five chambers having chamber lengths of 57.6 mm, 59.3 mm 60 mm, 47 mm and 57.3 mm, arranged in that order. Each chamber had a width of 12 mm and a depth of 49 mm. FIG. 3 graphically represents the data obtained for both conditions and illustrates the efficacy of an integrally mounted compressor muffler in accordance with the present invention.

What is claimed is:

1. A compressor muffler comprising:

a housing defining an inner space;

an inlet for receiving a compressed medium;

a muffling structure located in said inner space, wherein said muffling structure comprises a plurality of chambers for receiving said compressed medium from said inlet; an outlet for discharging said compressed medium; and a flow path located in said inner space, wherein said flow path communicates said inlet with said muffling structure and said muffling structure with said outlet; and wherein said plurality of chambers are defined by a plurality of substantially parallel side walls, an open end communicated with said flow path and a closed end opposed to said open end, said plurality of chambers having a plurality of different chamber lengths as defined between said open end and said closed end, said different chamber lengths being selected to interact with said compressed medium, whereby different noise-generating frequencies can be reduced.

2. A compressor muffler according to claim 1, wherein said housing further comprises a muffler cap and wherein said muffling structure comprises an upper portion positioned in said muffler cap and a lower portion positioned in said housing and wherein said muffler cap is removably mounted to said housing such that when said muffler cap is mounted to said housing said upper portion of said muffling structure and said lower portion of said muffling structure join to form said muffling structure.

3. A compressor muffler according to claim 2, wherein said housing and said muffler cap meet at adjacent surfaces and wherein at least one of said surfaces has a recessed groove and further comprises an O-Ring in said groove whereby said muffler cap is sealingly mounted to said housing.

4. A fluid compressor comprising:

a compressor inlet for receiving a medium;

a compressor for compressing said medium thereby creating a compressed medium;

a compressor outlet for discharging said compressed medium;

a compressor muffler having an inlet for receiving said compressed medium from said compressor outlet, a muffler housing defining an inner space, a muffling structure located in said inner space, wherein said muffling structure comprises a plurality of chambers for receiving said compressed medium from said inlet, an outlet for discharging said compressed medium and a flow path located in said inner space, wherein said flow path. communicates said inlet with said muffling structure and said muffling structure with said outlet; and wherein said plurality of chambers are defined by a plurality of substantially parallel side walls, an open end communicated with said flow path and a closed end opposed to said open end, said plurality of chambers having a plurality of different chamber lengths as defined between said open end and said closed end, said different chamber lengths being selected to interact with said compressed medium, whereby different noise-generating frequencies can be reduced.

5. A fluid compressor-according to claim 4, wherein said compressor muffler is disposed on said compressor such that said compressor outlet is aligned with said inlet so as to allow said inlet to receive said compressed medium into said inner space.

6. A compressor muffler according to claim 4, wherein said housing further comprises a muffler cap and wherein said muffling structure comprises an upper portion positioned in said muffler cap and a lower portion positioned in said housing and wherein said muffler cap is removably mounted to said housing such that when said muffler cap is mounted to said housing said upper portion of said muffling structure and said lower portion of said muffling structure join to form said muffling structure.

7. A fluid compressor according to claim 4, wherein said compressor is operable at a specified range of different noise-generating frequencies, and wherein said plurality of different chambers lengths have different lengths selected to match quarter wavelengths of said different noise-generating frequencies.

8. A method for reducing noise-generating frequencies from a compressed medium which comprises the steps of:

a) providing a compressed medium having noise-generating frequencies;

b) providing a compressor muffler having an inlet for receiving said compressed medium, a muffling structure having a plurality of chambers for interacting with said compressed medium, an outlet for discharging said compressed medium, and a flow path for communicating said inlet with said muffling structure and said muffling structure with said outlet;

c) introducing said compressed medium into said inlet such that said compressed medium enters said muffling structure via said flow path, and interacts with said plurality of chambers so as to reduce said noise-generating frequencies within said compressed medium so as to provide a damped compressed medium; and d) discharging said damped compressed medium via said outlet; and wherein said plurality of chambers are defined by a plurality of substantially parallel side walls, an open end communicated with said flow path and a closed end opposed to said open end, said plurality of chambers having a plurality of different chamber lengths as defined between said open end and said closed end, said different chamber lengths being selected to interact with said compressed medium, whereby different noise-generating frequencies can be reduced.

* * * * *